US005462099A

United States Patent [19]

Demarest et al.

[11] Patent Number: 5,462,099

[45] Date of Patent: Oct. 31, 1995

[54] SYSTEM AND METHOD FOR PRESSURIZING DISPENSING CONTAINERS

[75] Inventors: Scott W. Demarest, Racine; Robert E. Corba, Caledonia; Allen D. Miller, Mt. Pleasant; John M. Fritz, Oak Creek, all of Wis.; Donald J. Shanklin, Fullerton, Calif.

[73] Assignee: S. C. Johnson & Son, Inc., Racine, Wis.

[21] Appl. No.: 188,003

[22] Filed: Jan. 28, 1994

[51] Int. Cl.[6] ..... B65B 1/04; B65B 3/04

[52] U.S. Cl. ..... 141/3; 141/20; 141/39; 141/113; 141/197; 141/357; 200/518

[58] Field of Search ..... 141/3, 20, 39, 141/40, 102, 113, 197, 318, 351, 356, 357; 417/38; 200/61.2, 42.01, 81.5, 82 R, 82 C, 83 W, 518, 246

[56] References Cited

U.S. PATENT DOCUMENTS

| | | | |
|---|---|---|---|
| 2,025,141 | 12/1935 | Werder | 221/74 |
| 2,462,642 | 2/1949 | Jacobson et al. | 62/1 |
| 2,580,567 | 1/1952 | Martin | 249/63 |
| 2,689,075 | 9/1954 | Morton et al. | 226/107 |
| 2,763,415 | 9/1956 | Bagarozy | 226/68 |
| 2,989,993 | 6/1961 | Osmond et al. | 141/20 |
| 3,039,499 | 6/1962 | Peterson | 141/18 |
| 3,229,730 | 1/1966 | Welty et al. | 141/18 |
| 3,351,105 | 11/1967 | Di Perna | 141/18 |
| 3,357,461 | 12/1967 | Friendship | 141/6 |
| 3,442,303 | 5/1969 | Kellems | 141/18 |
| 3,572,402 | 3/1971 | Beffel | 141/3 |
| 3,586,068 | 6/1971 | Nickolson | 141/20 |
| 3,592,244 | 7/1971 | Chamberlin | 141/14 |
| 3,593,760 | 7/1971 | Beffel | 141/3 |
| 3,645,291 | 2/1972 | Finney | 137/588 |
| 3,654,743 | 4/1972 | McGeary | 53/88 |
| 3,696,973 | 12/1973 | Cottell | 239/341 |
| 3,799,218 | 3/1974 | Douglass | 141/18 |
| 3,890,662 | 6/1975 | Roberts | 9/313 |
| 3,934,622 | 8/1975 | Vitack et al. | 141/18 |
| 4,033,511 | 11/1975 | Chamberlin | 239/346 |
| 4,093,123 | 12/1975 | Maran | 239/322 |
| 4,165,025 | 8/1979 | Mascia et al. | 222/401 |
| 4,197,884 | 3/1980 | Maran | 141/383 |
| 4,202,470 | 5/1980 | Fujii | 222/130 |
| 4,492,320 | 1/1985 | Tada | 222/398 |
| 4,589,452 | 5/1986 | Clanet | 141/3 |
| 4,619,297 | 12/1986 | Kocher | 141/20 |
| 4,628,970 | 12/1986 | Vasella | 141/18 |
| 4,658,871 | 4/1987 | Gendey et al. | 141/293 |
| 4,658,979 | 4/1987 | Mietz et al. | 220/209 |
| 4,867,209 | 9/1989 | Santoiemmo | 141/19 |
| 4,911,212 | 3/1990 | Burton | 141/369 |
| 4,947,739 | 8/1990 | Owen | 99/323 |
| 5,215,447 | 6/1993 | San-Jou Wen | 417/415 |
| 5,343,904 | 9/1994 | Kaeser | 141/113 |

FOREIGN PATENT DOCUMENTS

| | | |
|---|---|---|
| 8808407 | 10/1988 | Germany . |
| 386868 | 4/1965 | Switzerland . |
| 847578 | 9/1960 | United Kingdom . |
| 1093498 | 12/1967 | United Kingdom . |
| 1161669 | 8/1969 | United Kingdom . |
| WO9101257 | 2/1991 | WIPO . |
| WO92/12912 | 1/1992 | WIPO . |
| WO93/04928 | 9/1992 | WIPO . |

*Primary Examiner*—Henry J. Recla
*Assistant Examiner*—Steven O. Douglas

[57] ABSTRACT

A portable electrically operated compressor system for pressurizing and repressurizing containers with compressed air. The system has two primary positions: A compressor position which has a single compressor motor switching mechanism which both activates the compressor motor and turns it off when the desired pressure level is reached and, designed to mate with the compressor system, a container position having an air inlet valve.

23 Claims, 7 Drawing Sheets

SYSTEM AND METHOD FOR PRESSURIZING DISPENSING CONTAINERS

TECHNICAL FIELD

This invention relates to the field of pressurized aerosol dispensing containers and more particularly to a portable system and method for pressurizing such containers.

BACKGROUND OF THE INVENTION

The need for portable units for pressurizing various objects is well known. Such devices run the gamut from the simple rigid hand operated bicycle pump type or flexible bellows-type foot operated compressor unit to small electric compressors that plug into the cigarette lighter socket of a vehicle to more sophisticated electric units like the one disclosed by U.S. Design Pat. No. 301,887 "Air Compressor or Similar Article" to Price et al.

However, while beach balls and tires always need to be inflated, and dispensing units such as flit-type guns must be continuously re-pressurized to work, there is another whole field of things that need pressurizing to be used: aerosol dispensing containers.

Most aerosol containers now on the market, regardless of whether they dispense hair spray or insect repellent, are pressurized at the point of filling by the addition of some sort of propellant gas, frequently propane or butane. (Chlorofluorocarbons were used in the past but they have been illegal for such use in the U.S. since 1978). Methods of pressurizing such containers without the need for chemical propellant additions are desirable for a variety of environmental, safety and economic reasons.

Currently available pressurized aerosol dispensing containers are single-use items that are not reusable or even easily recyclable.

Further, currently available pressurized aerosol dispensing containers need to comply with the U.S. Department of Transportation regulations governing the shipment of pressurized containers from the point of filling to the point of sale or use. While compliance with such regulations is a necessary safety precaution when pressurized containers are being shipped, such compliance adds complexity and cost to shipping. The containers of the present invention, whether of the single fill or refillable variety, can be shipped unpressurized and pressurized for use only by the actual user of the product contained in the container.

One approach to solving these problems is that provided by the Eurospray™ container marketed in the U.S. by LD Systems of Charlotte, N. C. This container is an operationally pressurizable plastic container having a built in pressure safety valve that can be refilled. Air is pumped into the unit by a pump which is an integral part of the container. While such a unit has many virtues, it does require the user to expend time and energy repressurizing the container, a fact that becomes significant in situations of either heavy use of the dispensing unit or for end users for who either the time factor or the required physical effort are concerns.

A refillable and pressurizable airless sprayer is disclosed by U.S. Pat. Nos. 4,197,884 and 4,093,123, both to Maran, "Airless Sprayer and Pressurizing System". These patents disclose a container with a moveable piston. The liquid to be dispensed is contained in a chamber above the piston head. A second chamber, below the piston head, can be pressurized, through a valve in the container, by an air compressor.

U.S. Pat. No. 3,592,244 to Chamberlin, "Flask-Charging Apparatus" discloses a compressor unit designed to pressurize an air flask to a predetermined pressure. The compressor unit has a flask-receiving area containing a projecting tube that will fit into an opening in the back of the air flask. The air flask itself simply contains pressurized air. The product to be dispensed from the system is contained in a separate dispensing unit which is connected to the air flask.

PCT publication WO93/04928 to Kaeser, "Aerosol Can Pressurizing Device and Aerosol Can Therefore" discloses an air compressor having a receptacle having a non-return valve into which an aerosol can be placed for repressurizing, and means for coupling the air compressor and the aerosol can, and means for turning the air compressor off when pressure within the can reaches a predetermined level.

SUMMARY DISCLOSURE OF INVENTION

The present invention is a system for pressurizing dispensing containers. The compressor portion of the system is a portable, electrically operated unit having one or more recesses sized to accept pressurizable containers. Each compressor recess has in its center a container charging seal and telescoping air tube which mates with an umbrella valve built into the base of each pressurizable container which is to be used with the unit.

The present invention solves one of the problems of the prior art in the area by providing a system for pressurizing aerosol dispensing containers that does not require chemical propellants. Pressurizable containers designed to be used in the system can be shipped unpressurized, thus avoiding the problems associated with the handling and shipment of pressurized vessels.

The present invention pressurizes dispensing containers with pressurized air, thus allowing dispensing without the use of propellant gases, a cost-savings factor. The system also presents environmental advantages: there is no need for the use of propellant gases which put volatile organic chemicals into the ambient atmosphere.

Another advantage of the present invention is that the user may repressurize and use (rather than having to throw away) any aerosol container (whether of the conventional propellant type or charged with compressed air) should the pressure within the container be or become insufficient to exhaust the contents of the container.

A second embodiment of the invention provides, as well, a solution to the recycling portion of the problem: the pressurizable containers are designed to be refillable. This embodiment, in addition to the advantages of the first embodiment also addresses the problem of re-use of the containers—they are refillable. And it is a simple fact that there is less wasted material (smaller amount of material that will have to ultimately be recycled or end up in a landfill) is produced by the use of any kind of refillable, reusable container than by the use of single use and dispose containers.

The present invention offers further advantages over the prior art in that it provides simplicities of use and of design. The container and compressor unit mate for pressurizing, with no need for needle valves nor potentially fragile locking systems to hold the container in place—the user's hand pressure suffices. The compressor unit has a simplified one piece compression piston and the container is pressurized directly—there are no internal separate compartments for the propellant and the contents to be dispersed. The compressor unit is constructed with a minimum of connection parts: the parts snap together. A unique integrated switching mechanism both activates the compressor motor and turns it off when the desired pressure in the container is reached.

BEST MODE FOR CARRYING OUT THE INVENTION

In the detailed descriptions of the drawings of the best mode for carrying out the invention, like reference numbers are used on the different figures to refer to like parts. Parts that are functionally similar but differ slightly in structure and/or location are indicated with the reference numbers followed by lower case letters.

Conventional sealing means such as o-rings and mounting and support systems for the various parts of the compressor unit are well known to those skilled in the art and are thus not described in detail here.

Figure 1:
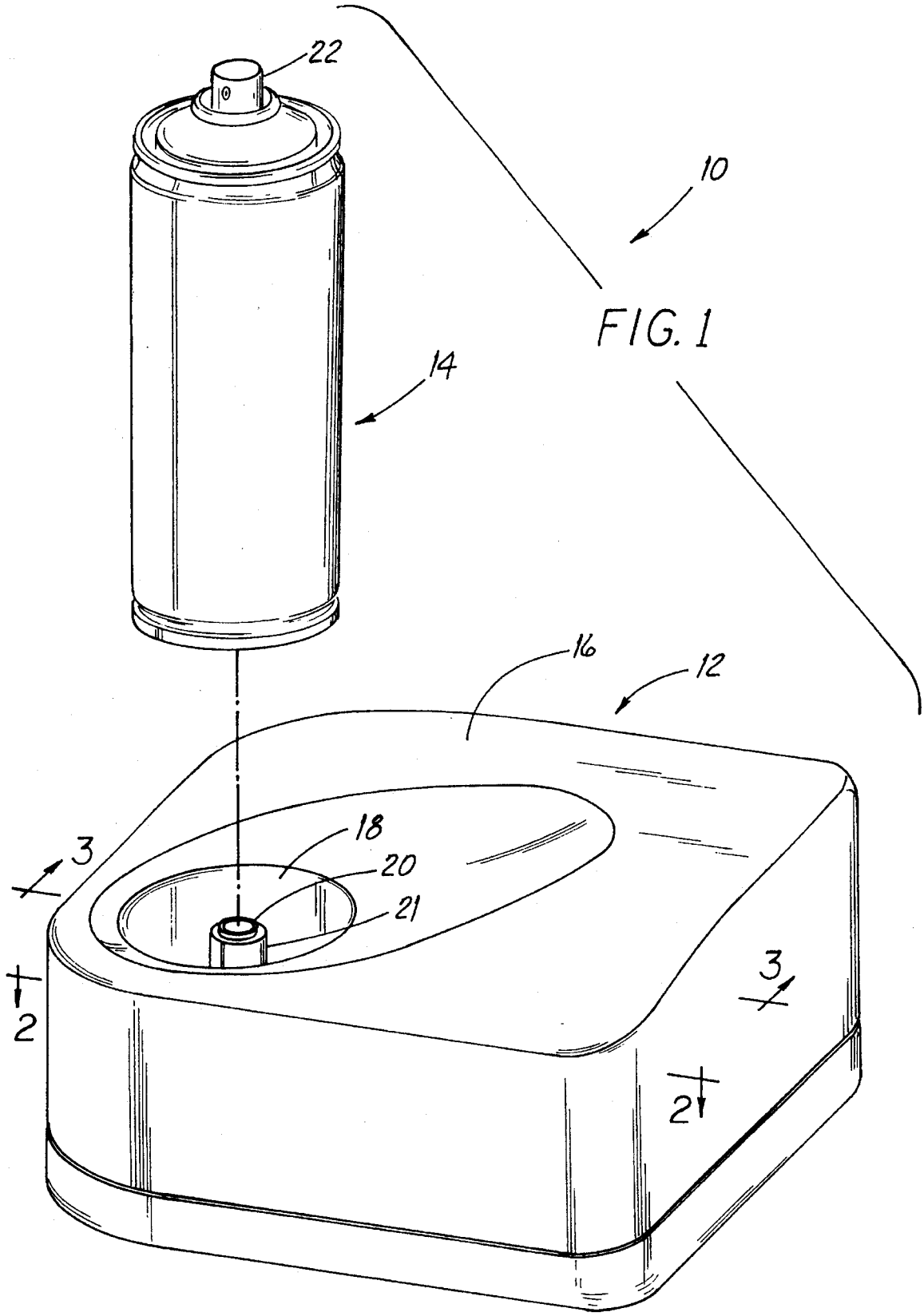
FIG. 1 is a perspective drawing of the system for pressurizing dispensing containers of the present invention showing the container and the compressor portions of the system.

FIG. 1 is a perspective view of system for pressurizing aerosol containers 10 which has two main components: compressor unit 12 and pressurizable container 14. Compressor unit 12 has compressor housing 16 which has, formed into one surface thereof container-accepting recess 18 within which is located container charging seal 20 to which is connected telescoping air tube 21 (shown in FIG. 3). Pressurizable container 14 has container dispensing valve 22 and, not visible in FIG. 1 but shown in FIG. 4, pressure-activated container inlet valve 24.

The geometry and material of container inlet valve 24 and container charging seal are critical, for the two must mate to form an air tight seal able to withstand high internal pressure with only the external pressure of the user's hand keeping the two parts together. Any leakage in the seal would make pressurizing the container impossible.

System for pressurizing aerosol containers 10 has two distinct but functionally interconnected on-off switching mechanisms in its electrical circuit: mechanically activated motor activation system (best shown in FIG. 3), which activates compressor motor 26 when pressurizable container 14 is placed into container-accepting recess 18 and pressed against container charging seal 20 to depress telescoping air tube 21 which, through a series of actions described below, activates compressor motor 26 and pneumatic pressure activated compressor motor deactivated system which deactivates compressor motor 26 when pressure responsive piston 27 (shown in FIGS. 2 and 5 and more completely in FIG. 6A–6C) in response to air pressure built up within manifold 30, moves outward from its resting location within manifold switch insert 33, and when fully extended (at a predetermined cut-off pressure level), interrupts the power supplied to compressor motor 26, thus turning it off.

Figure 2:
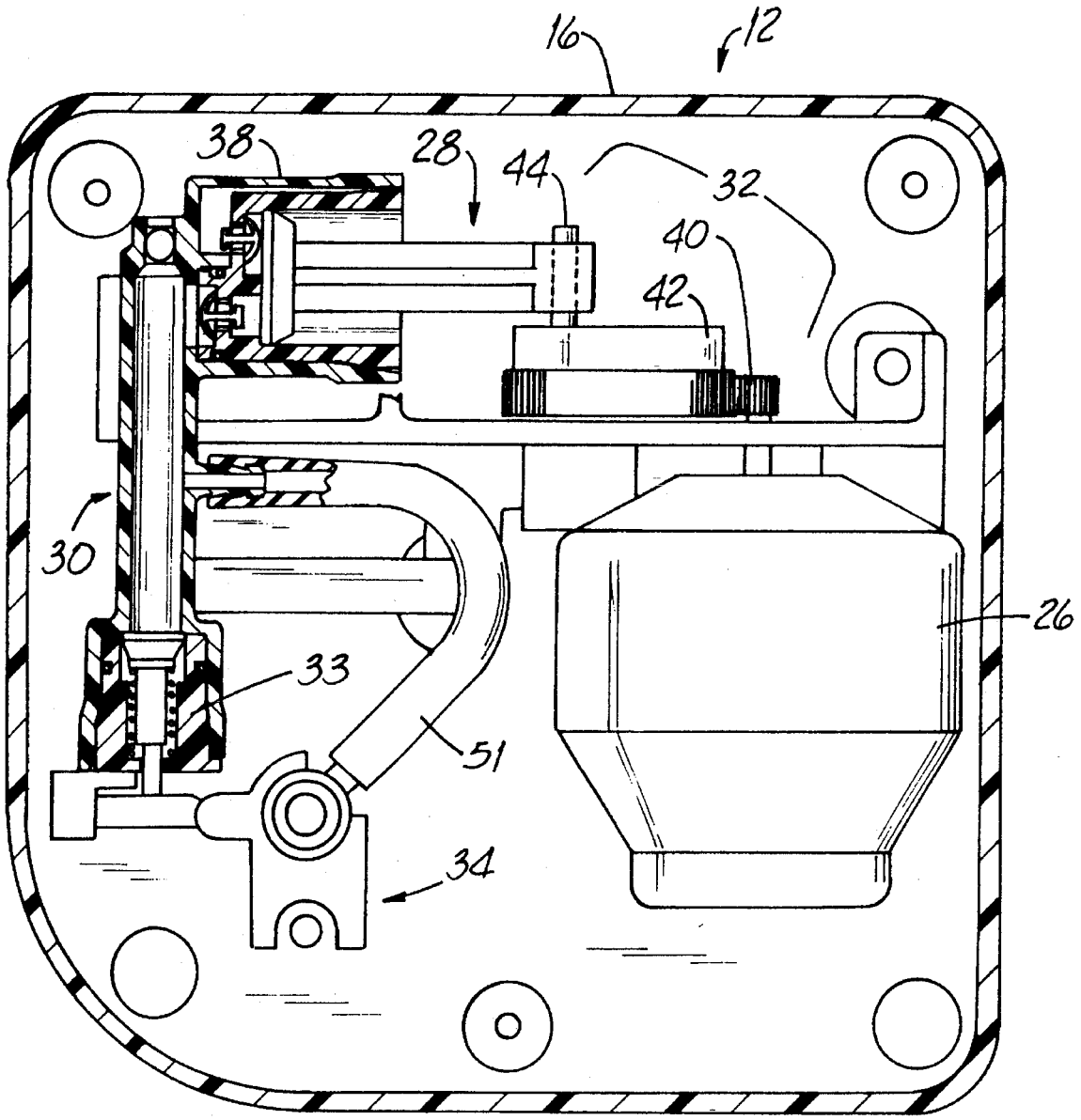
FIG. 2 is a top sectional drawing of the compressor portion, taken along line 2—2 of FIG. 1.
Figure 3:
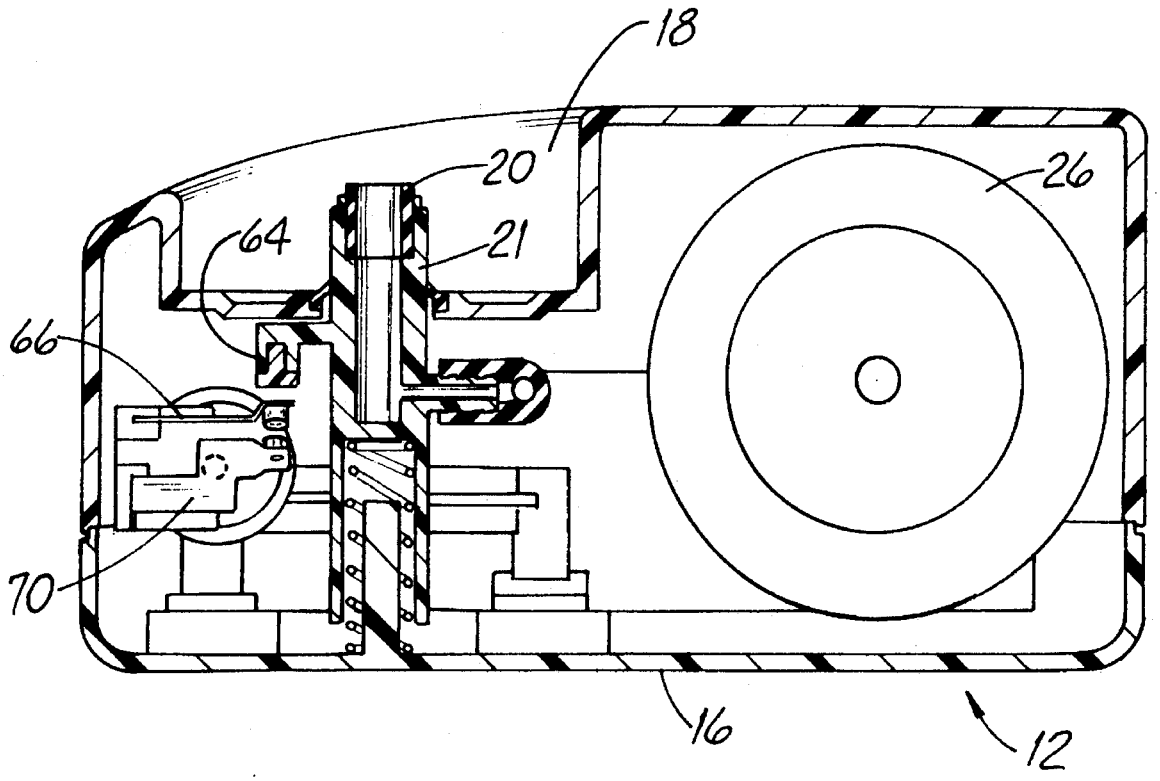
FIG. 3 is a side sectional view of the compressor portion, taken along line 3—3 of FIG. 1.

As shown in FIG. 2, which is a partially sectional top view of compressor unit 12, taken along line 2—2 on FIG. 1, and, as shown in FIG. 3 which is a side sectional view of compressor unit 12 taken along line 3—3 of FIG. 1, located within compressor housing 16 are electric compressor motor 26, (not illustrated in detail but of a type known to those skilled in the art), which is functionally connected to wobble piston 28 (which also integrally incorporates the functions of a connecting rod having and integral rod bearing surface, and sealing ring components which, in traditional piston technology, are separate pieces, in one molded component). Wobble piston 28 is moveably connected to compressor motor 26 by gearing system 32. Gearing system 32 is composed of spur gear 40 which is attached to the shaft of compressor motor 26. Spur gear 40 is operably connected to counter weight gear 42 which is in turn connected to crank shaft pin 44, eccentrically located on the upper surface of counter weight gear 42.

Compressor motor 26 is connected, by means of the usual circuitry, to a source of electric power. Alternating current from a wall socket is the preferred and expected type of power source for the unit, but, with appropriate circuitry, the use of DC current from batteries is also feasible.

Not shown but formed into the bottom of both the compressor housing 16 and container accepting recess 18 is a drain mechanism which allows any spilled material from the container to drain away from compressor motor 26 and its switching mechanism, thus minimizing mechanical or electrical problems in the unit.

Figure 4:
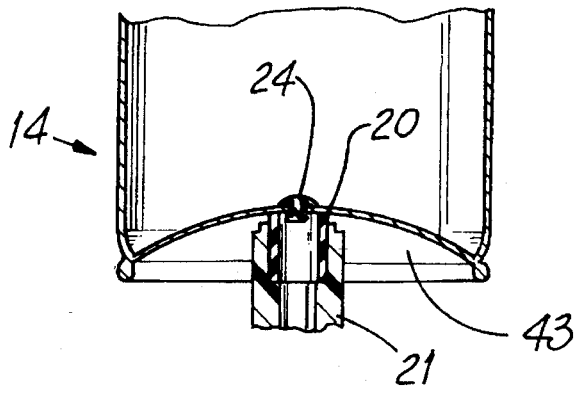
FIG. 4 is a partial side sectional view of the container portion of the system and the center charging post of the compressor portion.

FIG. 4 is a partial side sectional view of the lower portion of pressurizable container 14 showing pressure activated container air inlet valve 24 centrally located in container base portion 43. Also shown in FIG. 4 is a partial side sectional view of container charging seal 20 and telescoping air tube 21.

Figures 5, 5A:
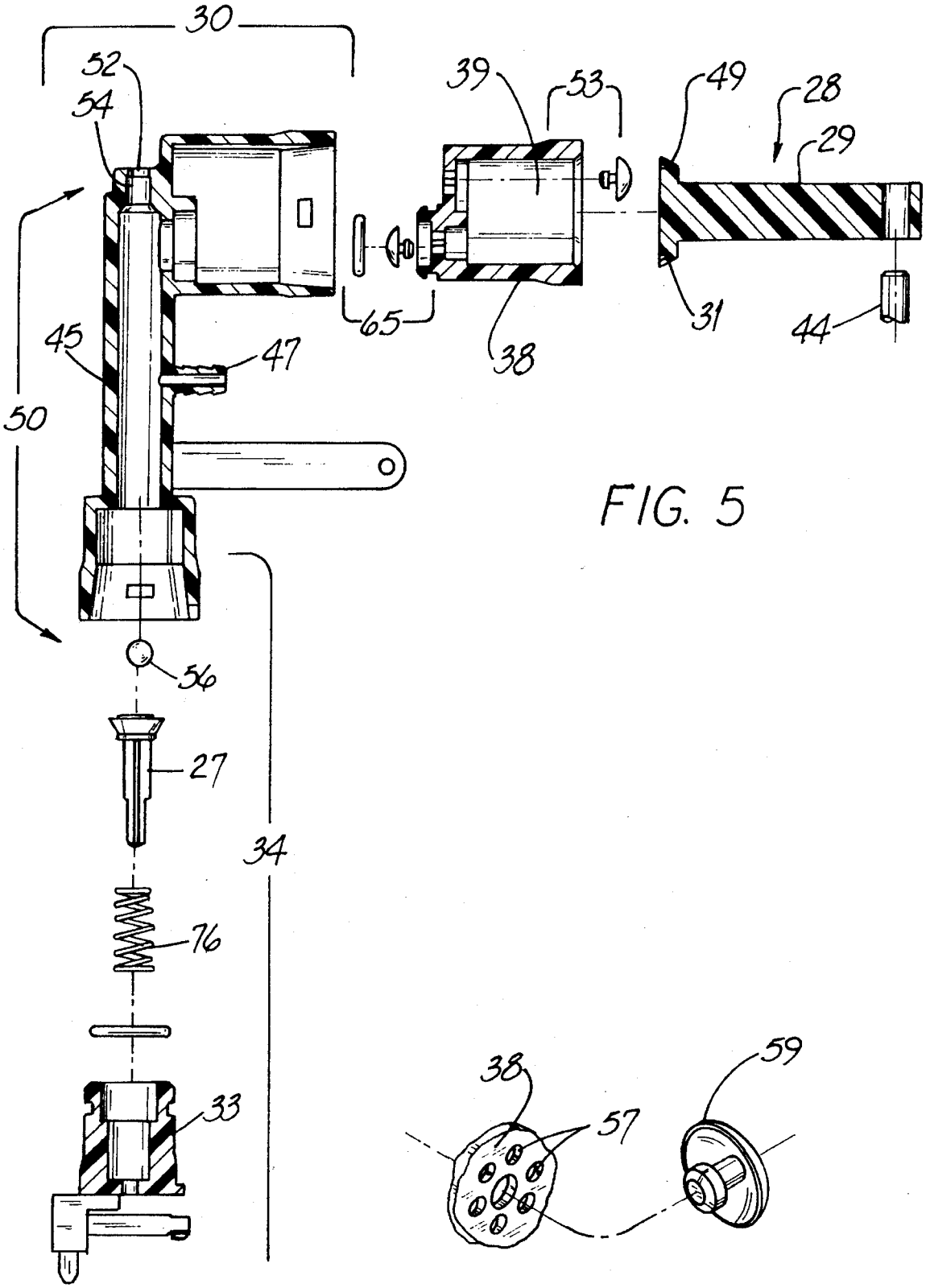
FIG. 5 is an exploded top sectional view of the compressor components of the system.
FIG. 5*a* is a partial perspective view of details of the air flow mechanism of the compressor portion.

FIG. 5, which is essentially an exploded portion of what is shown in FIG. 3, shows that wobble piston 28 is composed of wobble piston rod 29 and, integrally formed therewith, wobble piston head 31. Around the perimeter of wobble piston head 31 is wobble piston sealing flange 49. Wobble piston 28 is formed of a strong but deformable plastic such as an acetyl resin.

This construction allows wobble piston 28 to form an air tight seal with the interior surface of manifold cylinder insert 38, creating compression chamber 39.

Air is compressed by the unit as follows:

Wobble piston 28 is pressed up into manifold cylinder insert 38 by the action of compressor motor 26 transferred to wobble piston 28 by gearing system 32. As air within compression chamber 39 is compressed by this action, exhaust umbrella valve 55 is lifted, allowing the compressed air to pass into manifold runner 45. From manifold runner 45, the compressed air exits manifold air exit 47 to be led, through air carrying tube 51 to telescoping air tube 21 and container charging seal 20 and ultimately to pressurizable container 14.

On the intake stroke of wobble piston 28, a relative vacuum is created within compression chamber 39 and intake umbrella valve 53 is lifted, while exhaust umbrella valve 55 is closed, allowing ambient air to enter compression chamber 39 by means of an unshown air channel along the side of manifold cylinder insert 38.

Intake umbrella valve 53 and exhaust umbrella valve 55 have the same configurations, as shown in FIG. 5A. Valve holes 57 formed into manifold cylinder insert 38 allow air passage and umbrella seal 59 controls that air passage by either covering or uncovering valve holes 57. Umbrella valves 53 and 55 are both single components made of elastomeric material, which allows the valves to sealingly deform to close off valve holes 57 without the need for additional valve train mechanisms.

Manifold 30 has integrally formed into one end thereof one-time pressure relief valve 50, which is designed to vent compressed air from the unit should some malfunction of the unit allow excessive pressure to be built up within manifold 30.

Relief valve 50 is at one end open to the interior of manifold runner 45 and at its other end has pressure relief opening 52. Within relief valve chamber 54 rests relief ball 56, which is made of a deformable elastomeric material.

If the air pressure within manifold runner 45 ever exceeds a pre-determined limit, relief ball 56, which in its normal position forms an air-tight seal with pressure relief opening 52, will be forced through pressure relief opening 52. Pressure relief opening 52 and relief ball 56 are mutually configured so this escape can only occur when the pre-determined maximum air pressure has been reached.

Wobble piston rod 29 is, as is best shown in FIG. 2, connected in a close tolerance fit to crank shaft pin 44 with no additional bearing or bushing between the two.

Wobble piston sealing flange 49 is, as stated before, formed of a deformable plastic material. When wobble piston 28 is eccentrically moved by the rotation of crank shaft pin 44, wobble piston sealing flange 49 flexes from side to side to maintain an air tight seal between wobble piston head 31 and the interior of manifold cylinder insert 38 at all times during the compression and intake strokes of wobble piston 28.

As stated before, the compressor unit of the present invention is activated and, when the desired maximum pressure in the manifold (and thus in the pressurizable container) has been reached, deactivated, by a single switching mechanism.

Figure 6A:
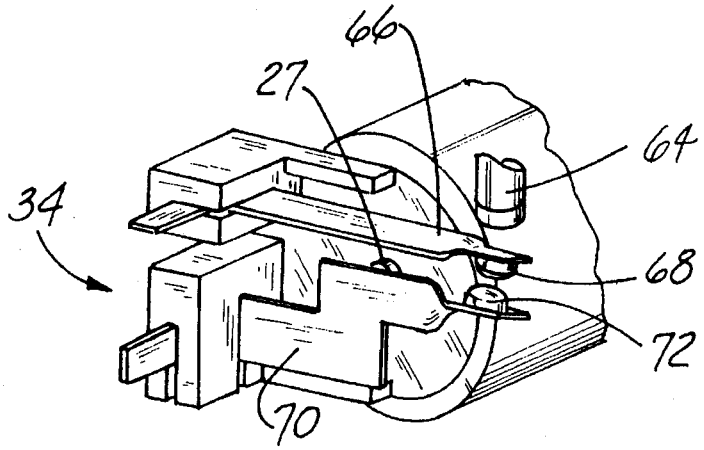
FIGS. 6A, 6B and 6C are perspective views of the switching mechanism of the compressor showing the contact points in different functional states.

External portions of this mechanism are visible in FIGS. 2 and 3, and details of different portions of the mechanism are shown in FIGS. 5 and 6A.

The activation portion of the switching cycle of switch mechanism is begun when pressurizable container 14 is inserted into container-accepting recess 18 and pressed against container charging seal 20 which is itself attached to telescoping air tube 21. Telescoping air tube 21, which is spring biased toward full extension, is thus pressed downward, and tube activation arm 64, which extends from one side of telescoping air tube 21, thus presses downward on top leaf spring 66.

As may be seen in FIG. 3 but more clearly in FIG. 6A, top leaf spring 66 itself has at one end top leaf contact 68, which is oriented at an approximate 45° angle to the main body of top leaf spring 66.

Situated just below top leaf spring 66 is bottom leaf spring 70 which has at one end bottom leaf electric contact 72, which is also oriented at an approximate 45° angle to the main body of bottom leaf spring 70.

Figure 6B:
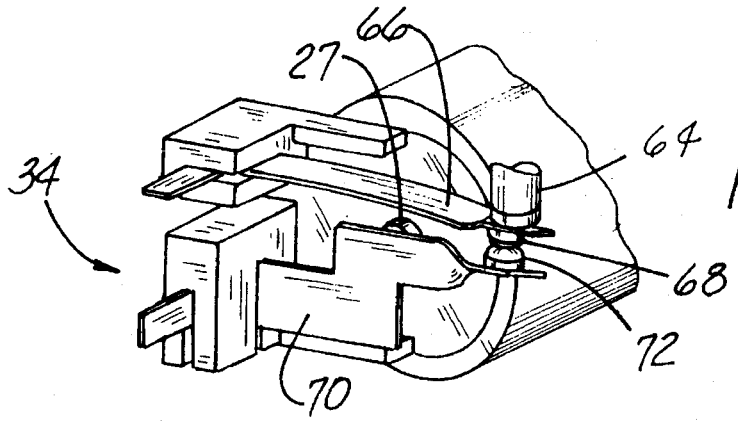

When top leaf spring 66 is flexed downward by tube activation arm 64, top leaf electric contact 68 is brought into contact with bottom leaf electric contact 72, thus completing the circuit with the source of electric power and activating compressor motor 26. This activated switch position is shown in FIG. 6B.

When the pressure in manifold runner 45 has reached its desired maximum, pressure-responsive piston 74, which is spring biased against manifold runner 45 by switch compression spring 76 (best seen in FIG. 5), is moved laterally into manifold switch insert 33 and begins to extend outward through manifold switch insert 33 to press against bottom leaf spring 70.

Figure 6C:
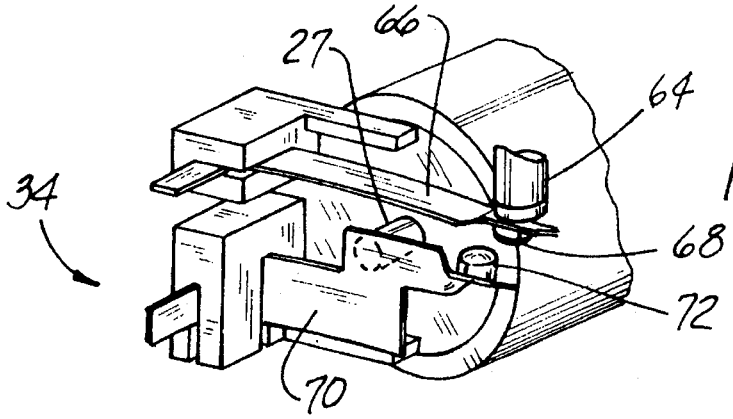

The pressure of pressure-responsive piston 74 against bottom leaf spring 70 forces bottom leaf electrical contact 72 away from top leaf electrical contact 68. When pressure responsive piston 74 is fully extended, which occurs at the desired preset pressure and is controlled by the compression characteristics of switch compression spring 76, the contact between top leaf electrical contact 68 and bottom leaf electrical contact 72 is broken, interrupting the electrical circuit and deactivating compressor motor 26. This deactivated switch position is shown in FIG. 6C.

Figure 7:
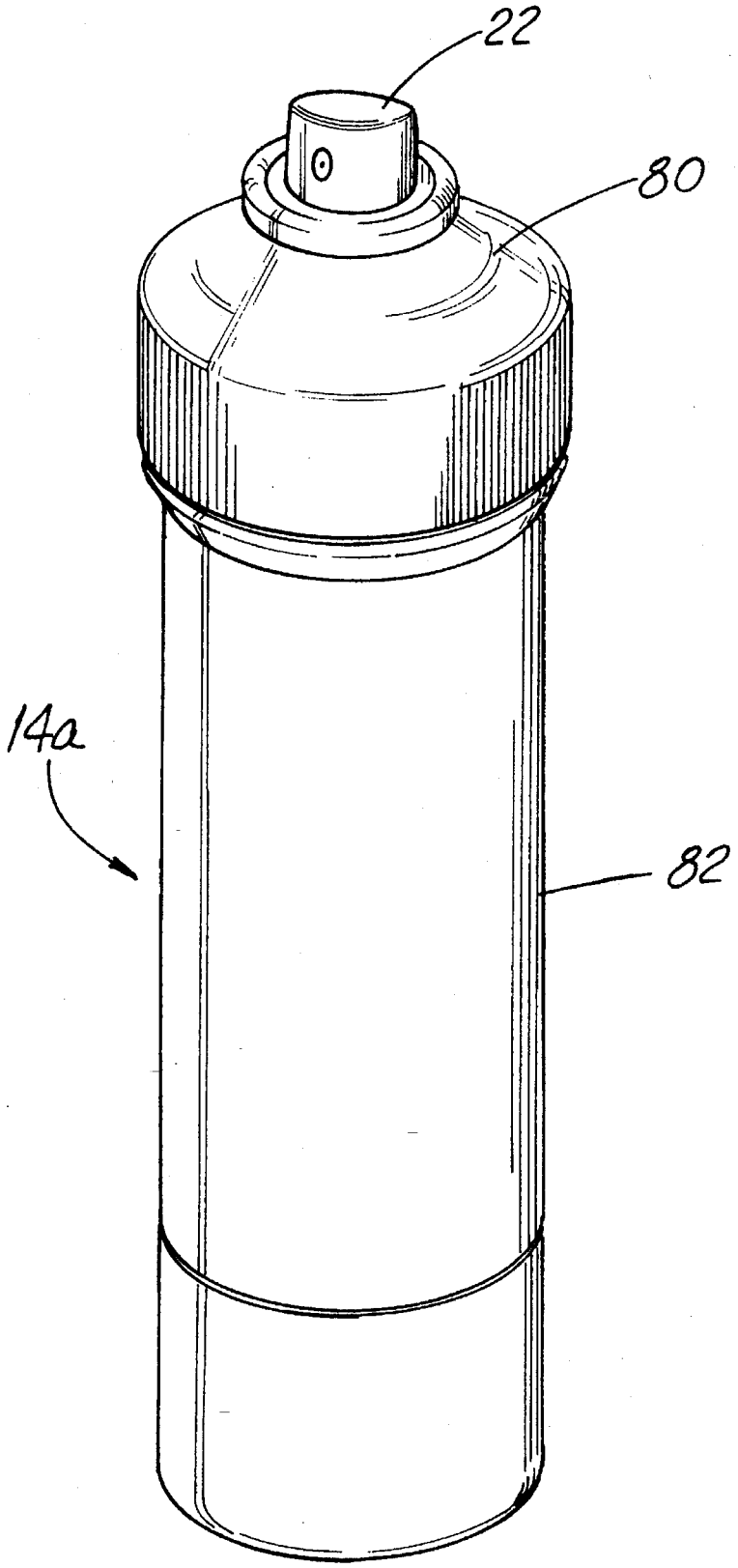
FIG. 7 is a perspective view of a second embodiment of the container portion of the system
Figure 8:
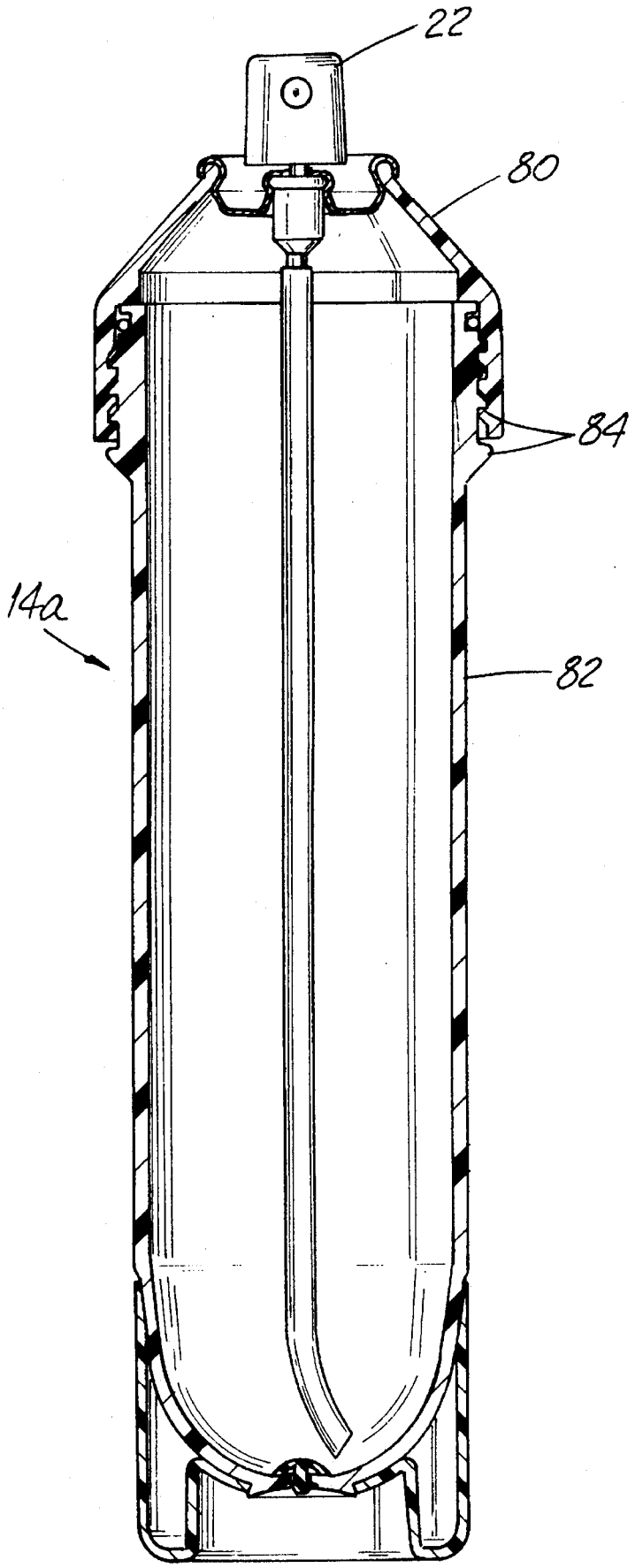
FIG. 8 is a side sectional view of the second embodiment of the container portion of the system.

FIG. 7 shows refillable pressurizable container 14*a*. As FIG. 8 shows, refillable pressurizable container 14*a* has refillable container bottom portion 80 and refillable container top portion 82 which are separably joined by mating screw threads 84 on the two portions. Located in the container base portion 43 is pressure activated container inlet valve 24.

System for pressurizing aerosol dispensing containers 10 is operated as follows:

The user takes non-pressurized but pressurizable dispensing container 14, places it into container-accepting recess 18 with sufficient pressure to compress container charging seal 20 and telescoping air tube 21 thus pressurizing pressurizable container 14 as described above.

When the pressure within pressurizable container 14 reaches a pre-determined level (40–120 psi average for most compressed gas aerosols),compressor motor 26 is deactivated in the manner described above.

The user would then remove now-pressurized container 14 and uses it in the same manner as any other aerosol can is used.

When the pressure from pressurizable container 14 has been exhausted, the user can repeat the sequence of operations to exhaust any remaining contents of the container.

If the container is of the refillable type shown in FIGS. 7 and 8, the user would, either for initial use or when the contents of refillable container 14*a* were exhausted, detach refillable container top portion 80 from refillable uncharged container bottom portion 82 by unscrewing mating screw threads 84, fill the container with the desired amount of the material to be dispensed, then reassemble, pressurize and use.

As will be apparent to one skilled in the art, various modifications can be made within the scope of the aforesaid description. Such modifications, which are within the ability of one skilled in the art, form a part of the present invention and are embraced by the claims.

INDUSTRIAL APPLICABILITY

Although the compressor portion of the system for pressurizing pressurizable objects of the present invention may be used to inflate or pressurize any object, the best use of the system will be the repressurizing of aerosol containers. It is anticipated that those users finding the system most useful will be those users who, due to the volume of their use of aerosol products, need to minimize waste and cost by being able to exhaust the entire contents of a container or by being able to refill and continue to use the same container. Such users would most likely be groups of people or businesses rather than individual consumers. Cleaning crews and professional insect control businesses would be two examples of such types of users.

What we claim is:

1. Apparatus for pressurizing aerosol dispensing containers, said apparatus comprising;

a housing formed with a recess to receive a charging valve portion of an aerosol dispensing container;

an air tube extending from within said housing into said recess to supply pressurized air through the charging valve of an aerosol dispensing container when the latter is pressed into said recess;

an electrically driven compressor located within said housing and arranged to supply air under pressure to said air tube when said compressor is connected to a source of electrical power;

an electrical switch comprising first and second electrical contacts each separately moveable toward and away from the other, said contacts being arranged in circuit with said compressor and said source of electrical power;

the first electrical contact being moveable into contact with the second electrical contact upon pressing said container into said recess; and the second electrical contact being movable away from the first electrical contact in response to a predetermined pressure in said air tube.

2. Apparatus according to claim 1 wherein said switch contacts are mounted on and are normally held out of contact by leaf springs.

3. Apparatus according to claim 2 wherein said leaf springs are arranged to flex in different planes.

4. Apparatus according to claim 3 wherein said switch contacts are oriented in a plane which is intermediate the flexure planes of the leaf springs.

5. Apparatus for pressurizing aerosol dispensing containers, said apparatus comprising;

a housing formed with a recess to receive a charging valve portion of an aerosol dispensing container;

an air tube extending from within said housing into said recess to abut an aerosol dispensing container and to form a seal around a charging valve of such container when such container is pressed into said recess, said air tube being moveable relative to the housing when such container is pressed into said recess with a force greater than that which will form said seal;

an electrically controlled compressor located within said housing and arranged to supply air under pressure to said air tube when said source is connected to a source of electrical power; and an electrical switch arranged in circuit with said compressor, said switch being arranged to close in response to movement of said air tube relative to said housing.

6. Apparatus according to claim 5 wherein said air tube is spring biased toward a sealing position with an aerosol dispensing container pressed into said recess.

7. Apparatus according to claim 6 wherein said air tube has a switch actuating arm arranged to operate said electrical switch upon movement of said air tube.

8. A system for pressurizing aerosol dispensing containers comprising:

a portable electrically operated pressurizing unit having a housing with a container-accepting position formed into one surface thereof, the container-accepting position having a telescoping air tube located therein and which is movable relative to the container-accepting position, and located within the housing, an electrically controlled compressor, and switching means for activating and deactivating the compressor in circuit with the compressor and a source of electric power, the switching means comprising a single switching mechanism, which comprises a mechanically activated compressor activation means and a pneumatic pressure activated compressor deactivation means, and an air carrying means operably connected at one end to the compressor and at its other end the telescoping air tube, and a pressurizable dispensing container having a top dispensing end and a bottom base end, the dispensing container being configured to removably fit into the container-accepting position and further having, built into the bottom base rind, a container air inlet valve, the telescoping air tube and the container air inlet valve being so configured and located that, when the dispensing container is placed into the container-accepting position, the container air inlet valve presses against the telescoping air tube, which activates the compressor and pressurized air from the compressor exits the telescoping air tube and enters the dispensing container through the container air inlet valve.

9. The system according to claim 8 wherein the switching means further comprises a first leaf spring having at one end thereof a first electrical contact, and a second leaf spring having at one end thereof a second electrical contact, the first and second leaf springs being so configured that the first and second electrical contacts are biased apart, and, when the first and second electrical contacts contact each other, the source of electric power is connected to the compressor, activating the compressor;

the switching means further comprising:

an activation arm attached to one side of the telescoping air tube and configured, so that when the dispensing container is pressed into the container-accepting position, the activation arm presses against the first leaf spring and pushes the first electrical contact against the second electrical contact, thus activating the compressor, and a pressure responsive piston movably yet sealingly located within the air carrying means, the pressure responsive piston configured so that, in response to pneumatic air pressure within the air carrying means, the pressure responsive piston is progressively moved outwardly from the air carrying means in such a manner that when a pre-determined pressure point is reached, the pressure responsive piston contacts and flexes the second leaf spring so that the second electrical contact is forced away from the first electrical contact, thus deactivating the compressor.

10. The system according to claim 9 wherein the first leaf spring has at one end thereof the first electrical contact oriented at an approximately 45° angle to the remainder of the first leaf spring and the second leaf spring has at one end thereof the second electrical contact oriented at an approximately 45° angle to the remainder of the second leaf spring.

11. The system according to 9 wherein the telescoping air tube has a top surface to which top surface is affixed an elastomeric surface which is configured so that a substantially air tight seal is formed when the dispensing container is pressed into the container-accepting position.

12. The system according to claim 8 wherein the dispensing container is refillable.

13. A system for pressurizing pressurizable objects comprising:

a pressurizable object having object air inlet means, and a portable electrically operated pressurizing unit, the pressurizing unit comprising a housing having a compressor air outlet formed into one surface thereof;

the housing having mating means configured to form a detachable connection with the object air inlet means, and, located within the housing, an electrically driven compressor, switching means for activating and deactivating the compressor in circuit with the compressor and a source of electric power, the switching means comprising a single switching mechanism, which comprises a mechanically activated compressor activation means and a pneumatic pressure activated compressor deactivation means, air carrying means operably connected at one end to the compressor and at its other end to the compressor air outlet, and an activation arm integral with the compressor air outlet spaced from and in proximity to the mechanically activated compressor activation means and the pneumatic pressure activated compressor deactivation means;

the pneumatic pressure activated compressor deactivation means comprising a pressure-responsive piston slidably located within the air carrying means, and the mechanically activated compressor activation means having at one end thereof a first electrical contact and the pneumatic pressure activated compressor deactivation means having at one end thereof a second electrical contact, the first and second electrical contacts being spaced apart and configured so that, when the activation arm forces the first and second electrical contacts against each other, the compressor is activated and when the pressure responsive piston forces the first and second electrical contacts apart, the compressor is switched off.

14. The system according to claim 13 wherein the switching mechanism further comprises a first leaf spring having at one end thereof the first electrical contact, and a second leaf spring having at one end thereof the second electrical contact, the first and second leaf spring being biased apart, the switching mechanism further comprising:

a telescoping air tube which forms part of the air carrying means and has attached to one side thereof the activation arm configured so that, when the pressurizable object is pressed into the mating means, the activation arm presses against the first leaf spring and pushes the first electrical contact against the second electrical contact, which activates the compressor, and the pressure responsive piston configured so that, in response to air pressure within the air carrying means, the pressure responsive piston is progressively moved outwardly from the air carrying means in such a manner that when a pre-determined pressure point is reached, the pressure responsive piston contacts and flexes the second leaf spring so that the second electrical contact is forced away from the first electrical contact, thus deactivating the compressor.

15. The system according to 14 wherein the telescoping air tube has a top surface to which top surface is affixed an elastomeric surface which is configured so that a substantially air tight seal is formed when the pressurizable object is pressed into the mating means.

16. The system according to claim 13 wherein the first leaf spring has at one end thereof the first electrical contact oriented at an approximately 45° angle to the remainder of the first leaf spring and the second leaf spring has at one end thereof the second electrical contact oriented at an approximately 45° angle to the remainder of the second leaf spring.

17. The system according to claim 13 wherein the pressurizable object is refillable.

18. A method of pressurizing an aerosol dispensing container comprising:

taking a pressurizable aerosol dispensing container having a top dispensing end and a bottom base end, the bottom base end having a centrally located pressure activated container air inlet valve located therein, and a portable electrically operated compressor unit having a housing with a container-accepting recess on one surface thereof and a telescoping air tube located therein being movable relative to the container-accepting recess, located within the housing is an electrically controlled compressor, switching means for activating and deactivating the compressor in circuit with the compressor and a source of electric power, and an air carrying means operably connected to, at one end, the compressor, and at the other end, the telescoping air tube, wherein the switching means comprises a single switching mechanism having a mechanically-activated compressor activation system and a pneumatic pressure activated compressor deactivation system, pressing the dispensing container into the container-accepting recess, thereby activating the compressor by pressing the bottom base end against the telescoping air tube, allowing pressurized air to exit the compressor unit through the telescoping air tube and to enter the dispensing container through the container air inlet valve, and removing the pressurized dispensing container from the compressor unit when the compressor has switched off.

19. The method according to claim 18 wherein the switching means comprises a first leaf spring having at one end thereof a first electrical contact, and a second leaf spring having at one end thereof a second electrical contact, the first and second leaf springs being so configured that the first and second electrical contacts are biased apart, and, when the first and second electrical contacts contact each other, the compressor is activated, the switching mechanism further comprising:

an activation arm attached to one side of the telescoping air tube and configured, when the dispensing container is pressed into the container-accepting recess, so that the activation arm presses against the first leaf spring and pushes the first electrical contact against the second electrical contact, thus activating the compressor, and a pressure responsive piston movably yet sealingly located within the air carrying means, the pressure responsive piston configured so that, in response to air pressure within the air carrying means, the pressure responsive piston is progressively moved outwardly from the air carrying means in such a manner that, when a pre-determined pressure point is reached, the pressure responsive piston contacts and flexes the second leaf spring so that the second electrical contact is forced away from the first electrical contact, thus deactivating the compressor.

20. The method according to claim 19 wherein the switching mechanism further comprises the first leaf spring having at one end thereof the first electrical contact oriented at an approximately 45° angle to the remainder of the first leaf spring and the second leaf spring having at one thereof the second electrical contact oriented at an approximately 45° angle to the remainder of the second leaf spring.

21. The method according to claim 19 wherein the container air inlet valve is an umbrella valve.

22. The method according to claim 19 wherein the telescoping air tube has a top surface to which top surface is affixed an elastomeric surface which is configured so that a substantially air tight seal is formed when the pressure container is pressed into the container-accepting recess.

23. The method according to claim 18 wherein the dispensing container is refillable.

* * * * *